US005718995A

United States Patent [19]

Eichorst et al.

[11] Patent Number: 5,718,995

[45] Date of Patent: Feb. 17, 1998

[54] COMPOSITE SUPPORT FOR AN IMAGING ELEMENT, AND IMAGING ELEMENT COMPRISING SUCH COMPOSITE SUPPORT

[75] Inventors: Dennis John Eichorst, Fairport; Cathy Ann Fleischer, Rochester; Jeremy Grace, Rochester; Paul Daniel Yocobucci, Rochester, all of N.Y.

[73] Assignee: Eastman Kodak Company, Rochester, N.Y.

[21] Appl. No.: 662,188

[22] Filed: Jun. 12, 1996

[51] Int. Cl.[6] ..... G03G 19/00; G03C 8/00; G03C 1/76

[52] U.S. Cl. ..... 430/39; 430/200; 430/530; 430/531; 430/532

[58] Field of Search ..... 430/39, 530, 531, 430/532, 200

[56] References Cited

U.S. PATENT DOCUMENTS

| | | | |
|---|---|---|---|
| 3,837,886 | 9/1974 | Tatsuta et al. | 430/510 |
| 3,849,166 | 11/1974 | Omichi et al. | 430/533 |
| 4,203,769 | 5/1980 | Guestaux | 430/631 |
| 4,689,359 | 8/1987 | Ponticello et al. | 430/642 |
| 4,914,018 | 4/1990 | Besio et al. | 430/528 |
| 4,954,430 | 9/1990 | Ishigaki et al. | 430/534 |
| 5,310,640 | 5/1994 | Markin et al. | 430/527 |
| 5,326,689 | 7/1994 | Murayama | 430/530 |
| 5,360,706 | 11/1994 | Anderson et al. | 430/529 |
| 5,360,707 | 11/1994 | Kato et al. | 430/538 |
| 5,368,995 | 11/1994 | Christian et al. | 430/530 |
| 5,425,980 | 6/1995 | Grace et al. | 430/532 |
| 5,427,835 | 6/1995 | Morrison et al. | 430/527 |
| 5,439,785 | 8/1995 | Boston et al. | 430/530 |
| 5,451,495 | 9/1995 | Falkner et al. | 430/531 |
| 5,457,013 | 10/1995 | Christian et al. | 430/496 |
| 5,484,694 | 1/1996 | Lelental et al. | 430/530 |
| 5,491,045 | 2/1996 | DeBoer | 430/200 |
| 5,609,969 | 3/1997 | Clatanoff et al. | 428/632 |

FOREIGN PATENT DOCUMENTS

| | | |
|---|---|---|
| 511764A1 | 11/1992 | European Pat. Off. . |
| 516275A1 | 12/1992 | European Pat. Off. . |
| 607905A1 | 7/1994 | European Pat. Off. . |
| 674218A1 | 9/1995 | European Pat. Off. . |
| 94/24607 | 10/1994 | WIPO . |

*Primary Examiner*—Mark Chapman
*Attorney, Agent, or Firm*—Andrew J. Anderson

[57] ABSTRACT

A composite support for an imaging element is described, which composite support comprises a polymeric film and an electrically conductive layer, wherein the polymeric film comprises a surface which has been activated by energetic treatment, the electrically conductive layer comprises an electrically conductive agent dispersed in an aqueous dispersible polymeric binder comprising an aliphatic, anionic polyurethane having an ultimate elongation to break of at least 350 percent, and the electrically conductive layer is in contiguous contact with the activated surface of the polymeric film. Imaging elements for use in an image-forming process are also described, which element comprise such composite supports and at least one image-forming layer. The invention provides composite supports and imaging elements containing an electrically conductive antistatic layer having excellent adhesion to energetic surface-treated polymer film supports, and of auxiliary layers to the electrically conductive antistatic layer.

32 Claims, No Drawings

COMPOSITE SUPPORT FOR AN IMAGING ELEMENT, AND IMAGING ELEMENT COMPRISING SUCH COMPOSITE SUPPORT

FIELD OF THE INVENTION

This invention relates in general to supports for imaging elements, such as photographic, electrostatophotographic and thermal imaging elements, and in particular to composite supports comprising an energetic surface-treated polymeric film and an electrically conductive antistatic layer, and imaging elements comprising such polymeric film, antistatic layer, and an image-forming layer. More particularly, this invention relates towards such composite supports and imaging elements wherein the antistatic layer is effectively adhered directly in contiguous contact with the polymer film without use of a subbing layer.

BACKGROUND OF THE INVENTION

Imaging elements are generally complicated systems comprising a support, adhesion or tie layers, image recording layers and auxiliary layers for improved performance such as electrically conductive antistatic layers, lubricant layers, abrasion resistant layers, curl-control layers, antihalation layers, etc. The multiple layers required to achieve the desired performance results in a complicated coating process with severe requirements for adhesion to the support and between layers.

Adhesion of the auxiliary layers to a polymer film support has traditionally been achieved through the use of suitable adhesion or tie layers referred to as a subbing system. Subbing systems generally involve chemical treatment of the polymer surface with an etch or "bite" agent to improve adhesion of a tie layer. Subsequently, a polymeric tie layer is coated which has good adhesion to the chemically treated surface and to which subsequently applied layers have good adhesion. Some useful compositions for this purpose include polymers containing vinylidene chloride such as vinylidene chloride/methyl acrylate/itaconic acid terpolymers or vinylidene chloride/acrylonitrile/acrylic acid and the like; butadiene-based copolymers, glycidyl acrylate, or methacrylate containing copolymers, or maleic anhydride containing copolymers. These and other suitable compositions are described, for example, in U.S. Pat. Nos. 2,627,088; 2,698,240; 2,943,937; 3,143,421; 3,201,249; 3,271,178; 3,443,950; and 3,501,301. The polymeric subbing layer is in many instances overcoated with an additional subbing layer comprised of gelatin, typically referred to as a Gel sub. The first functional layer, which may frequently desirably be an antistatic layer for control of electrostatic charge, is generally applied after such surface-treatment and application of such subbing layers. This approach has several drawbacks, particularly with increasing demand for reduced environmental impact. Typical etch or bite agents include chlorinated or phenolic materials which may be corrosive and environmentally deleterious. The indicated etch or bite agents are also typically coated from solvents, in many cases chlorinated solvents which are intended to be reduced. The subbing systems generally require at least two separate coatings which result in manufacturing waste for each coating.

Problems associated with electrostatic charge in the manufacture and utilization of imaging elements are well-known. The accumulation of charge can result in dirt or dust attraction, producing physical defects. The discharge of accumulated charge during application or use of radiation sensitive layers (for example, photographic emulsions) can produce irregular fog patterns or static marks in the light sensitive layer(s). These static charge problems have become increasingly more severe due to increased photographic emulsion sensitivity, increased coating machine speeds, and increased post-coating drying efficiency. Transport charging results from the tendency of high dielectric materials to accumulate electrical charge when in relative motion to other materials. This results in static charging during coating and post-coating operations such as slitting and spooling. Static charge build-up may also occur during use of imaging elements, for example during winding of a roll of photographic film out of and back into a film cassette in an automatic camera. Static discharge during magnetic reading and writing can result in increased bit error rates. These problems can be exacerbated at low relative humidities. Similarly, high speed processing of imaging elements can result in static charge generation.

Due to the increasing demands for static charge control, electrically conductive "antistatic" layers incorporating a wide variety of ionically-conducting and electronically-conducting materials have been incorporated into photographic imaging, magnetic recording and other imaging elements. The requirements for antistatic layers in silver halide photographic films are especially demanding because of the stringent optical requirements associated with such films. As such antistatic layers are frequently the first functional auxiliary layer coated on a polymeric film support, much prior work has been directed towards providing good adhesion between such layers and the polymer film. Further, as additional auxiliary layers may be desirably coated over such antistatic layers, much work has also been directed towards providing good adhesion between the antistatic layer and the overcoated layers.

As an example of auxiliary layers which may be desirably coated over an antistatic layer, it is well known from various U.S. patents, including U.S. Pat. Nos. 3,782,947; 4,279,945; 4,990,276; 5,217,804; 5,147,768; 5,229,259; 5,255,031; and others that a radiation-sensitive silver halide photographic element may contain a transparent magnetic recording layer which can advantageously be employed to record information into and read information from the magnetic recording layer by techniques similar to those employed in the conventional magnetic recording art. The use of a magnetic recording layer for information exchange allows improved photographic print quality through input and output of information identifying the light-sensitive material, photographic conditions, printing conditions and other information. Additional auxiliary layers which may also be desirably present in imaging elements include abrasion resistant and other protective layers, abrasive-containing layers, adhesion promoting layers, curl control layers, transport control layers, lubricant layers and other magnetic layers for purposes such as improved web conveyance, optical properties, physical performance and durability.

The increasing need of additional layers for improved performance has resulted in numerous coating passes, greater complexity and more demanding adhesion requirements for imaging elements. Due to the desire to reduce the number of coating passes, reduce solvent emissions, and reduce or eliminate hazardous chemicals there has been a significant emphasis on identifying alternative methods of improving adhesion to polyester film supports. One such alternative method is to subject the support to some form of "energetic" treatment prior to coating. Examples of energetic treatments include glow-discharge treatment (GDT) or plasma treatment, corona-discharge treatment (CDT), ultraviolet radiation (UV) treatment, electron-beam treatement, and flame treatment. In some instances, these treatments produce adhesion superior to that of other approaches. In addition, such treatments can reduce the number of required coating passes, by replacing a subbing layer. Furthermore, such treatments have the potential to reduce solvent emissions and reduce or eliminate the use of hazardous chemicals associated with additional coatings or chemical etchants added to coating solutions.

Although it would be desirable to use an appropriate energetic treatment of a support to enable adhesion of a functional layer without the need for any subbing layers, energetic treatments have generally been used in combination with a subbing layer or some additional process treatments to provide adequate adhesion. Ponticello et al (U.S. Pat. No. 4,689,359) describe the use of CDT in combination with a single subbing layer made from an aqueous blend of gelatin and a mixture of polymerized vinyl monomers. Omichi et al (U.S. Pat. No. 3,849,166) describe the use of UV treatment in combination with a wet coating of hydrogen peroxide and then an additional subbing layer (either a hydrophilic resin solution or a gelatin dispersion containing a solvent or swelling agent). Kawamoto et al (EP 0 607 905 A2) describe in their examples the use of UV treatment in combination with heat and a single subbing layer made of gelatin, organic solvents, and p-chlorophenol (an etchant for polyester). Stroebel et al (EP 0 516 275 A1) describe the use of CDT in a nitrogen atmosphere in combination with heat and a single subbing layer made with polyalkyl acrylate or polyalkyl methacrylate and gelatin. Tatsuta and Ueno (U.S. Pat. No. 3,837,886) describe the use of GDT in combination with surface roughening of a polystyrene substrate; they find that GDT is ineffective without first roughening the polystyrene substrate. In these cases, the combination of surface-treatment and a single subbing layer replaces a two-layer subbing system or a single layer subbing system that has inferior adhesion in the absence of the energetic treatment. Energetic treatments are not found to be effective without subbing, etchants in the layer, or some other surface-treatment such as surface roughening. Ishigaki et al (U.S. Pat. No. 4,954,430), e.g., disclose glow-discharge treatment of polyester supports including polyethylene naphthalate for use in photographic imaging elements, claims being specific to the use of vinylidene chloride based subbing layers. Murayama (U.S. Pat. No. 5,326,689) teaches the use of glow-discharge treatment in the presence of water vapor to improve adhesion of gelatin based layers to polyester supports which have a glass transition temperature in the range of 90°–200° C. such as polyethylene naphthalate. Murayama found that glow-discharge was not especially effective for polyethylene terephthalate having a glass transition temperature of 69° C. Furthermore, if the partial pressure of water vapor was below 10% it was difficult to obtain sufficient adhesive properties. Finally, he teaches that glow-discharge treatment with water vapor in combination with heat treatment of a polyester support having a glass transition temperature in the given range is preferred.

Grace et al (U.S. Pat. No. 5,425,980) demonstrate that GDT provides better adhesion than obtained by the use of CDT with the single subbing layer disclosed by Ponticello. Furthermore, Grace et al demonstrate that GDT can be used to obtain excellent adhesion of a gelatin-based subbing layer (with no etchants, water vapor or heat treatment) or adhesion of a silver halide photographic emulsion layer directly to polyester support treated with GDT. Stroebel et al teach that superior adhesion of a specific coating to the desired substrate hinges on the correct combination of treatment of the polymer support and coating chemistry. Grace et al further teach that the details of the surface chemistry resulting from energetic surface-treatments is important for obtaining good adhesion to specific coatings. Thus, the surface-treatment produced by energetic treatment of the support must be appropriate for the chosen coating chemistry. The various forms of energetic surface-treatment are interchangeable only if they produce the same surface functionalities in similar amounts or if the coating to be applied is capable of significant chemical interaction with a broad range of surface functionalities that encompass those produced by the various forms of treatment.

U.S. Pat. Nos. 5,368,995 and 5,457,013 describe the use of metal antimonates as antistatic agents for use in imaging elements. The imaging elements may optionally contain a transparent magnetic layer overlying the antistatic layer. The antistatic layer may optionally be coated on a glow-discharge treated polyester support. The art as taught demonstrates excellent conductivity and dry adhesion of a gelatin based antistatic layer to glow-discharge treated polyethylene naphthalate and of a transparent magnetic layer to the antistatic layer. However, the practice of these layers was found to have inadequate wet adhesion and a limited range of treatment conditions which gave adequate adhesion.

U.S. Pat. No. 5,360,707 teaches the use of antistatic formulations of $V_2O_5$ in a polyesterionomer binder having excellent stability and adhesion to underlying and overlying layers. U.S. Pat. No. 5,427,835 discloses the use of sulfopolymers for binders with vanadium oxide antistatic compositions. These patents disclose the use of binders which impart improved stability to $V_2O_5$ and could potentially be applied to surface-treated supports. World Pat. No. 94/24607 indicates that the sulfopolyester based antistatic layer containing vanadium oxide has good adhesion to untreated supports. U.S. Pat. No. 5,427,835 teaches that the sulfopolyester based antistatic layer has excellent dry adhesion to flame treated polyethylene terephthalate. While antistatic formulations according to the above patents when overcoated with a transparent magnetic recording auxiliary layer are found to have excellent dry adhesion to surface-treated polyester supports, such formulations exhibit poor wet adhesion characteristics. U.S. Pat. No. 5,439,785 describes the use of epoxy-silanes as adhesion promoters in conjunction with the sulfopolyester vanadium oxide layers for improved antistatic performance and adhesion.

Yamauchi et al (EP 511,764 A1) describe the combination of an antistatic layer and a separate transparent magnetic recording layer in which at least one of the binders from the antistatic layer or magnetic layer contains a functional polar group consisting of $—SO_3M$, $—OSO_3M$ and $—P(=O)(OM_1)(OM_2)$, wherein M is a hydrogen atom, a potassium atom or a lithium atom; $M_1$ and $M_2$ are the same with or different from each other and each represent a hydrogen atom, a sodium atom, a potassium atom, a lithium atom or an alkyl group. It is preferred that the binder resin be a combination of a urethane resin and a polyvinyl chloride type resin and that both of these resins be modified. The conductive particle is selected from the group consisting of ZnO, $TiO_2$, $SnO_2$, $Al_2O_3$, $In_2O_3$ and $SiO_2$. The art as taught requires the use of solvent coatings for the conductive layer which is generally not preferred. Furthermore, it is preferable to avoid the use of polyvinyl chloride resins taught by Yamauchi.

Clearly, it would be preferable to provide a functional layer such as an antistatic layer which adheres directly to surface-treated polyester film supports. Based on the prior art and Applicants' experience with antistatic layers coated on energetically treated supports, however, workable combinations of energetic surface-treatment and antistatic materials are not readily found. In fact, the above examples of the prior art demonstrate that it is difficult to find a polymeric material which acts as a suitable binder for antistatic materials, has good adhesion to a treated polyester and to which auxiliary layers can be adhered. Furthermore, the requirement for dry adhesion, and in many cases wet adhesion, requires co-optimization of the antistatic layer and treatment conditions which may be limited in scope and difficult for process scale-up.

Accordingly, it would be desirable to provide an antistatic layer comprising a polymeric binder which has excellent adhesion to a variety of polymeric film supports and energetic surface-treatment methods. Furthermore, adhesion to the treated support is desired to be extremely robust allowing scale-up of the process. The layer should also provide excellent adhesion for a variety of polymeric materials which may be used as binders for auxiliary layers which may be required for a fully functional imaging element. It is also preferred that adhesion be accomplished without the use of addenda such as chlorinated etchants which potentially pose an environmental impact. Finally, it is preferred that the polymeric binder be aqueous soluble or aqueous dispersible in order to reduce or eliminate the use of organic coating solvents. The present invention meets these and other requirements by providing an antistatic layer comprising an aqueous dispersible polyurethane which has excellent adhesion to a variety of energetic surface-treatment conditions, has excellent adhesion of subsequent auxiliary layers, and can be a host for a wide variety of antistatic agents.

SUMMARY OF THE INVENTION

In accordance with one embodiment of the invention a composite support for an imaging element is described, which composite support comprises a polymeric film and an electrically conductive layer, wherein the polymeric film comprises a surface which has been activated by energetic treatment, the electrically conductive layer comprises an electrically conductive agent dispersed in an aqueous dispersible polymeric binder comprising an aliphatic, anionic polyurethane having an ultimate elongation to break of at least about 350 percent, and the electrically conductive layer is in contiguous contact with the activated surface of the polymeric film.

In accordance with a further embodiment of the invention, an imaging element for use in an image-forming process is described, which element comprises a support, at least one image-forming layer, and an electrically conductive layer, wherein the support comprises a polymeric film having a surface which has been activated by energetic treatment, the electrically conductive layer comprises an electrically conductive agent dispersed in an aqueous dispersible polymeric binder comprising an aliphatic, anionic polyurethane having an ultimate elongation to break of at least about 350 percent, and the electrically conductive layer is in contiguous contact with the activated surface of the support.

The invention provides composite supports and imaging elements containing an electrically conductive antistatic layer having excellent adhesion to energetic surface-treated polymer film supports, and of auxiliary layers to the electrically conductive antistatic layer.

DETAILED DESCRIPTION OF THE INVENTION

The composite supports of this invention can be used for many different types of imaging elements. While the invention is applicable to a variety of imaging elements such as, for example, photographic, electrostatophotographic, photothermographic, migration, electrothermographic, dielectric recording and thermal-dye-transfer imaging elements, the invention is primarily applicable to photographic elements, particularly silver halide photographic elements. Accordingly, for the purpose of describing this invention and for simplicity of expression, photographic elements will be primarily referred to throughout this specification; however, it is to be understood that the invention also applies to other forms of imaging elements.

Photographic elements which can be provided with an antistatic layer in accordance with the invention can differ widely in structure and composition. For example, they can vary greatly in the type of support, the number and composition of image-forming layers, and the kinds of auxiliary layers that are included in the elements. In particular, the photographic elements can be still films, motion picture films, x-ray films, graphic arts films, prints, or microfiche. They can be black-and-white elements or color elements. They may be adapted for use in a negative-positive process or for use in a reversal process.

Polymer film supports which are useful for the present invention include polyester supports such as, polyethylene terephthalate, poly-1,4-cyclohexanedimethylene terephthalate, polyethylene 1,2-diphenoxyethane-4,4'-dicarboxylate, polybutylene terephthalate, and polyethylene naphthalate and the like; and blends or laminates thereof. Particularly preferred embodiments are polyethylene terephthalate and polyethylene naphthalate. The supports can either be colorless or colored by the addition of a dye or pigment. It should also be noted that our invention applies to suitable polyester supports with treatments and/or coatings applied to the side opposite that which is to be coated with the electrically conductive antistatic layer of the present invention.

Because of the unexpected latitude in treatment afforded by our invention, a wide range of surface chemistries are useful for promoting adhesion of the disclosed electrically conductive antistatic layer. Therefore, useful film supports can be surface-treated by various energetic processes including, but not limited to corona-discharge treatment, glow-discharge or plasma treatment, ultraviolet radiation, flame treatment and electron beam treatment. Preferred surface-treatment methods are corona-discharge treatment, glow-discharge treatment and exposure to ultraviolet radiation.

Corona-discharge may be carried out in air or a controlled atmosphere containing oxygen or nitrogen using commercially available corona-discharge treatment equipment. Glow-discharge treatment may involve a variety of gases such as oxygen, nitrogen, helium, argon, carbon dioxide, ammonia, water vapor, or admixtures thereof. Most preferred are oxygen, nitrogen or admixtures thereof. Glow-discharge treatment may be achieved using reduced pressures or atmospheric pressures. Treatment doses may range from approximately 0.01 to 10 $J/cm^2$ and more preferably from 0.05 to 5 $J/cm^2$.

The ranges of treatment doses, gas compositions and pressures used in the examples below are known to produce a wide range of surface chemistries on treated supports. Specifically, it is shown in U.S. Pat. No. 5,425,980 that nitrogen glow-discharge treatments produce a variety of nitrogen-containing species such as imines, primary amines, and secondary amines on treated polyester surfaces. In addition, the nitrogen treatments can induce rearrangement of the ester functionality. The distribution and amount of nitrogen-containing species and degree of ester rearrangement depend on treatment conditions. In contrast, oxygen glow-discharge treatments do not incorporate nitrogen but incorporate oxygen and induce formation of hydroxyl, ether, epoxy, carbonyl, and carboxyl species on the treated polyester surface. The distribution and amount of these oxygen containing species depend on treatment conditions. Furthermore, corona-discharge treatments incorporate significantly less nitrogen than nitrogen GDT and induce significantly less rearrangement of ester groups than either oxygen or nitrogen GDT. Further chemical differences between CDT and plasma-treated supports (i.e., GDT) are revealed by contact angle measurements as a function of pH of the contacting liquid.

Any of a variety of discharge geometries may be used, including treatment of a free span of web or the web may alternatively be placed against a holder or drum. Provision may also be made for treating both sides of the web, either for application of this invention to either side, or for situations where a different (or identical) treatment is required on the opposite side for some other function.

The electrically conductive antistatic layer of the elements according to the invention comprises an aqueous dispersible binder which may have a variety of antistatic or other functional materials dispersed within it. The functional materials may include ionically conducting materials, electronically conductive particles, electronically conductive polymers, magnetic particles, abrasive particles, matte particles, dispersants, surface active agents, dyes, lubricants, haze reducing agents, adhesion promoting agents, hardeners, etc. A preferred embodiment of the invention includes the use of electronically conductive materials to yield an electrically conductive antistatic layer. The electrically conductive layer binder of the present invention comprises an aqueous dispersible polyurethane polymer which is aliphatic in nature, has an anionic particle charge and is characterized by an ultimate elongation prior to breaking of at least about 350 percent. Several suitable aliphatic, anionic polyurethanes for use in accordance with the invention are commercially available, for example, from Witco Chemical Co., Greenwich, Conn., including Witcobond W-290H (ultimate elongation 600%), W-293 (725%), W-506 (550%), W-236 (450%), and W-234 (350%).

Electronically conductive particles which may be used in the electrically conductive antistatic layer of the present invention include, e.g., conductive crystalline inorganic oxides, conductive metal antimonates, and conductive inorganic non-oxides. Crystalline inorganic oxides may be chosen from ZnO, $TiO_2$, $SnO_2$, $Al_2O_3$, $In_2O_3$, $SiO_2$, MgO, BaO, $MoO_3$, $WO_3$, and $V_2O_5$ or composite oxides thereof, as described in, e.g., U.S. Pat. Nos. 4,275,103; 4,394,441; 4,416,963; 4,418,141; 4,431,764; 4,495,276; 4,571,361; 4,999,276 and 5,122,445. The conductive crystalline inorganic oxides may contain a "dopant" in the range from 0.01 to 30 mole percent, preferred dopants being Al or In for ZnO; Nb or Ta for $TiO_2$; and Sb, Nb or halogens (F, Cl, Br and I) for $SnO_2$. Alternatively, the conductivity can be enhanced by formation of oxygen defects by methods well known in the art. The use of antimony-doped tin oxide at an antimony doping level of at least 8 atom percent and having an X-ray crystallite size less than 100 Å and an average equivalent spherical diameter less than 15 nm but no less than the X-ray crystallite size as taught in U.S. Pat. No. 5,484,694 is most preferred.

Conductive metal antimonates suitable for use in accordance with the invention include those as disclosed in, e.g., U.S. Pat. Nos. 5,368,995 and 5,457,013. Preferred conductive metal antimonates have a rutile or rutile-related crystallographic structures and may be represented as $M^{+2}Sb^{+5}{}_2O_6$ (where $M^{+2}$=$Zn^{+2}$, $Ni^{+2}$, $Mg^{+2}$, $Fe^{+2}$, $Cu^{+2}$, $Mn^{+2}$, $Co^{+2}$) or $M^{+3}Sb^{+5}O_4$ (where $M^{+3}$=$In^{+3}$, $Al^{+3}$, $Sc^{+3}$, $Cr^{+3}$, $Fe^{+3}$). Several colloidal conductive metal antimonate dispersions are commercially available from Nissan Chemical Company in the form of aqueous or organic dispersions. Alternatively, U.S. Pat. Nos. 4,169,104 and 4,110,247 teach a method for preparing $M^{+2}Sb^{+5}{}_2O_6$ by treating an aqueous solution of potassium antimonate with an aqueous solution of an appropriate metal salt (e.g., chloride, nitrate, sulfate, etc.) to form a gelatinous precipitate of the corresponding insoluble hydrate which may be converted to a conductive metal antimonate by suitable treatment.

Conductive inorganic non-oxides suitable for use as conductive particles in the present invention include: TiN, $TiB_2$, TiC, $NbB_2$, WC, $LaB_6$, $ZrB_2$, MoB, and the like, as described, e.g., in Japanese Kokai No. 4/55492, published Feb. 24, 1992.

The conductive particles present in the electrically conductive antistatic layer are not specifically limited in particle size or shape. The particle shape may range from roughly spherical or equiaxed particles to high aspect ratio particles such as fibers, whiskers or ribbons. Additionally, the conductive materials described above may be coated on a variety of other particles, also not particularly limited in shape or composition. For example the conductive inorganic material may be coated on non-conductive $SiO_2$, $Al_2O_3$ or $TiO_2$ particles, whiskers or fibers.

The conductive agent may be a conductive "amorphous" gel such as vanadium oxide gel comprised of vanadium oxide ribbons or fibers prepared by any variety of methods, including but not specifically limited to melt quenching as described in U.S. Pat. No. 4,203,769, ion exchange as described in U.S. Pat. No. DE 4,125,758, or hydrolysis of a vanadium oxoalkoxide as claimed in WO 93/24584. The vanadium oxide gel is preferably doped with silver to enhance conductivity. Other methods of preparing vanadium oxide gels which are well known in the literature include reaction of vanadium or vanadium pentoxide with hydrogen peroxide and hydrolysis of $VO_2$ OAc or vanadium oxychloride.

The conductive agent may also be a carbon filament as disclosed by Papadopoulos in copending, commonly assigned U.S. Ser. No. 08/588,180 filed Jan. 18, 1996, the disclosure of which is incorporated by reference herein. Recently there have been several commercial sources of carbon filaments or fibers including Applied Sciences, Inc., Cedarville, Ohio, under license from GM. Alternatively, carbon filaments suitable for antistatic applications may be prepared by a variety of methods including pyrolysis of polymeric fibers such as polyacrylonitrile, and vapor phase growth or seeded vapor phase growth. The preferred method is vapor phase growth using metal catalyst seed particles which initiate fiber growth and act as a diffusion transport medium. In this process the fiber diameter can be controlled by the size of the catalyst particle.

Electrically conductive polymers as exemplified by polyanilines and polythiophenes may also be used as conductive agents for the electrically conductive antistatic layer of the imaging elements in accordance with the invention.

Preferred conductive materials are tin oxide, zinc oxide, titanium oxide, zinc antimonate, indium antimonate, vanadium oxide gel, or carbon fibers and more preferably antimony-doped tin oxide, zinc antimonate or vanadium oxide. For antimony-doped tin oxide, it is most preferred that the small crystallite size material taught in U.S. Pat. No. 5,484,694 be used. Generally, increased loading of conductive materials results in reduced adhesion, although in certain instances adhesion may be enhanced by the presence of the conductive material. Therefore, the desired ratio of conductive material to binder and the total coverage of the electrically conductive antistatic layer depend on the required conductivity for charge control and the nature of the conductive material.

For conductive particles (e.g., conductive metal oxides, conductive metal antimonates, or conductive inorganic non-oxides) which are roughly equiaxed or of a low aspect ratio (i.e., less than approximately 3) it is preferred that the conductive particles be present in the electrically conductive layer in an amount from approximately 10 to 80 volume percent. The total coverage of the electrically conductive layer containing conductive oxide fine particles or metal antimonates may preferably range from approximately 0.10 to 1.0 $g/m^2$. For a conductive vanadium oxide gel it is preferred that the ratio of polyurethane binder/vanadium oxide gel be in the weight ratio of 1/2 to 300/1 and more preferably from approximately 1/1 up to 200/1. The coverage of such an electrically conductive layer depends on an appropriate thickness to achieve the desired resistivity level which is determined in a large part on the polyurethane to antistatic agent ratio. Preferred coverages range from approximately 0.005 to 1.0 $g/m^2$ with the higher coverages preferred at higher binder/vanadium oxide ratios.

In addition to antistatic agents, the electrically conductive antistatic layer may include addenda such as dispersants, surface active agents, plasticizers, solvents, co-binders, matte particles, magnetic particles, filler particles, soluble dyes, solid particle dyes, haze reducing agents, adhesion promoting agents, hardeners, etc. For altering the coating and drying characteristics it is a common practice in the art to use surface active agents (coating aids) or to include a water miscible solvent in an aqueous dispersion. Suitable solvents include ketones such as acetone or methyl ethyl ketone, and alcohols such as ethanol, methanol, isopropanol, n-propanol, and butanol.

The antistatic layer coating formulation may be prepared as a single dispersion comprising conductive material, binder and optional coating aids or other addenda or alternatively may be prepared as multiple dispersions which are brought together and mixed immediately prior to coating in a technique known as mixed melt formation. This latter process reduces the potential need of surface active agents for improved dispersion stability (dispersants) and avoids potential solution incompatibility problems between the binder and conductive agent or addenda. The mixed melt process is particularly useful for the preparation of electrically conductive layers containing vanadium oxide gel.

The electrically conductive antistatic layer of the present invention may optionally be overcoated with a wide variety of additional functional or auxiliary layers such as abrasion resistant layers, curl control layers, transport control layers, lubricant layers, image recording layers, additional adhesion promoting layers, layers to control water or solvent permeability, and transparent magnetic recording layers. In a preferred embodiment of the invention, the antistatic layer is overcoated with at least a transparent magnetic recording layer and an optional lubricant layer. A permeability control layer may also be preferably coated between the antistatic layer and transparent magnetic recording layer. Magnetic layers suitable for use in the composite supports and imaging elements in accordance with the invention include those as described, e.g., in *Research Disclosure*, November 1992, Item 34390. *Research Disclosure* is published by Kenneth Mason Publications, Ltd., Dudley House, 12 North Street, Emsworth, Hampshire P010 7DQ, ENGLAND.

Suitable polymeric binders for auxiliary layers (including transparent magnetic recording layers), coated over the electrically conductive antistatic layer of the present invention include: gelatin; cellulose compounds such as cellulose nitrate, cellulose acetate, cellulose diacetate, cellulose triacetate, carboxymethyl cellulose, hydroxyethyl cellulose, cellulose acetate butyrate, cellulose acetate propionate, cellulose acetate phthalate and the like; vinyl chloride or vinylidene chloride-based copolymers such as, vinyl chloride-vinyl acetate copolymers, vinyl chloride-vinyl acetate-vinyl alcohol copolymers, vinyl chloride-vinyl acetate-maleic acid copolymers, vinyl chloride-vinylidene chloride copolymers, vinyl chloride-acrylonitrile copolymers, acrylic ester-vinylidene chloride copolymers, methacrylic ester-vinylidene chloride copolymers, vinylidene chloride-acrylonitrile copolymers, acrylic ester-acrylonitrile copolymers, methacrylic ester-styrene copolymers, thermoplastic polyurethane resins, thermosetting polyurethane resins, phenoxy resins, phenolic resins, epoxy resins, polycarbonate or polyester resins, urea resins, melamine resins, alkyl resins, urea-formaldehyde resins, and the like; polyvinyl fluoride, butadiene-acrylonitrile copolymers, acrylonitrile-butadiene-acrylic acid copolymers, acrylonitrile-butadiene-methacrylic acid copolymers, polyvinyl alcohol, polyvinyl butyral, polyvinyl acetal, styrene-butadiene copolymers, acrylic acid copolymers, polyacrylamide, their derivatives and partially hydrolyzed products; and other synthetic resins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, and olefins and aqueous dispersions of polyurethanes or polyesterionomers. Preferred binders are polyurethanes, vinyl chloride based copolymers, acrylics or acrylamides and cellulose esters, particularly cellulose diacetate and cellulose triacetate.

Permeability control layers are useful for protecting those antistatic agents for which conductivity may degrade upon exposure to photographic processing solutions. Examples of such antistatic agents include vandium oxide gels, ionically conducting materials, and some conducting polymers such as polyaniline. The additional auxiliary layers may be present in the imaging element either above or below the image recording element or on the side of the support opposite the recording layer. Preferred permeability control layers comprise relatively hydrophobic polymers selected from the above list of binders, including cellulose esters such as cellulose diacetate and cellulose triacetate, polyesters, and poly(alkyl(meth)acrylates).

Transparent magnetic recording layers used in composite supports and imaging elements in accordance with preferred embodiments of the invention are comprised of magnetic particles dispersed in a film-forming binder. The layer may contain optional additional components for improved manufacturing or performance such as crosslinking agents or hardeners, catalysts, coating aids, dispersants, surfactants, including fluorinated surfactants, charge control agents, lubricants, abrasive particles, filler particles and the like. The magnetic particles of the present invention can comprise ferromagnetic or ferrimagnetic oxides, complex oxides including other metals, metallic alloy particles with protective coatings, ferrites, hexaferrites, etc. and can exhibit a variety of particulate shapes, sizes, and aspect ratios. Ferromagnetic oxides useful for transparent magnetic coatings include $\gamma$-$Fe_2O_3$, $Fe_3O_4$, and $CrO_2$. The magnetic particles optionally can be in solid solution with other metals and/or contain a variety of dopants and can be overcoated with a shell of particulate or polymeric materials. Preferred additional metals as dopants, solid solution components or overcoats are Co and Zn for iron oxides; and Li, Na, Sn, Pb, Fe, Co, Ni, and Zn for chromium dioxide. Surface-treatments of the magnetic particle can be used to aid in chemical stability or to improve dispersability as is commonly practiced in conventional magnetic recording. Additionally, magnetic oxide particles may contain a thicker layer of a lower refractive index oxide or other material having a low optical scattering cross-section as taught in U.S. Pat. Nos. 5,217,804 and 5,252,441. Cobalt surface-treated $\gamma$-iron oxide is the preferred magnetic particle.

While the present invention provides electrically conductive layers which in general have excellent adhesion directly to polymeric films which have been treated with a variety of energetic surface-treatment conditions as well as to auxiliary layers which may be coated over the electrically conductive layer, it may be further advantageous to provide an adhesion promoting layer above the electrically conductive layer when a vanadium oxide gel is used as the electrically conductive agent, as adhesion requirements for such formulations has been found to be especially demanding. Commonly assigned, concurrently filed U.S. application Ser. No. 08/660,968 filed Jun. 12, 1996 (Kodak Docket No. 73867AJA), the disclosure of which is incorporated by reference herein, teaches the use of adhesion promoting layers for use with vanadium oxide conductive layers, wherein the adhesion promoting layers comprises a polyurethane binder of the type disclosed for use in the electrically conductive layer of the instant invention. Such adhesion promoting layers may be particularly advantageous for use in combination with the instant invention where the binder/vanadium oxide ratio in the electrically conductive layer is less than 12/1, and especially less than 4/1.

The image-forming layer for imaging elements comprising an electrically conductive layer in accordance with the invention may be present on the same side of the support as the electrically conductive layer or on the opposite side. In preferred embodiments of the invention, the imaging element comprises a photographic element, and the image forming layer comprises a silver halide emulsion layer on the opposite side of the support relative to the electrically conductive layer.

Photographic elements in accordance with the preferred embodiment of the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, antihalation layers, overcoat layers, subbing layers, and the like.

Photographic elements in accordance with one embodiment of the invention are preferably used in conjunction with an applied magnetic layer as described in *Research Disclosure*, November 1992, Item 34390. It is also specifically contemplated to use composite supports according to the invention in combination with technology useful in small format film as described in *Research Disclosure*, June 1994, Item 36230. *Research Disclosure* is published by Kenneth Mason Publications, Ltd., Dudley House, 12 North Street, Emsworth, Hampshire P010 7DQ, ENGLAND.

In the following discussion of suitable materials for use in the photographic emulsions and elements that can be used in conjunction with the composite supports of the invention, reference will be made to *Research Disclosure*, September 1994, Item 36544, available as described above, which will be identified hereafter by the term "*Research Disclosure*." The Sections hereafter referred to are Sections of the *Research Disclosure*, Item 36544.

The silver halide emulsions employed in the image-forming layers of photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX.

In addition to silver halide emulsion image-forming layers, the image-forming layer of imaging elements in accordance with the invention may comprise, e.g., any of the other image forming layers described in Christian et al. U.S. Pat. No. 5,457,013, the disclosure of which is incorporated by reference herein.

The following examples demonstrate the superior performance and robustness of the present invention over other layers for adhesion to surface-treated supports.

Energetic surface-treated polyester supports coated with polyurethane based electrically conductive antistatic layers and overcoated with transparent magnetic recording layers were evaluated for antistatic performance, dry adhesion and wet adhesion performance.

Antistatic performance was evaluated by measuring the internal resistivities of the overcoated electrically conductive antistatic layers by the salt bridge method (see, for example, "Resistivity Measurements on Buried Conductive Layer" by R. A. Elder, pages 251–254, 1990 EOS/ESD Symposium Proceedings). This measurement is referred to as a wet electrode resistivity (WER) measurement. Results are reported as log ohm/sq with lower numbers indicating less resistivity and better antistatic performance. For many applications a WER value of 10 log ohm/sq or less is desired.

Dry adhesion of the samples was evaluated by scribing a small crosshatched region into the coating with a razor blade, placing a piece of high tack adhesive tape over the scribed area, and then quickly stripping the tape from the surface. The relative amount of material removed from the scribed region is a qualitative measure of dry adhesion. No removal is rated as excellent; less than 1 percent removal is good, between 1 and 10 percent is fair, 10 to 50 percent is poor, and greater than or equal to 50 percent is very poor.

Wet adhesion was evaluated in a manner which simulates photographic processing. A one millimeter wide line was scribed into the overcoat layer. The sample was then placed into a Flexicolor developer solution at 38° C. for 3 minutes and 15 seconds and removed. The sample was then placed in Flexicolor developer and a weighted rubber pad (approximately 3.5 cm dia.) was rubbed vigorously across the sample in a direction perpendicular to the line. The applied weight was 900 g. The amount of additional material removed is a relative measure of wet adhesion. The same rating scale was used as for dry adhesion.

COMPARATIVE EXAMPLES

The following comparative examples demonstrate a variety of electrically conductive antistatic layer formulations which are well known in the art. These examples demonstrate that antistatic formulations in the prior art do not have the superior adhesion performance demonstrated for the present invention.

Comparative Example 1

Antistatic formulations were prepared using a conductive vanadium oxide sol dispersed in a sulfopolyester as taught in U.S. Pat. No. 5,427,835. The vanadium oxide sol was a silver doped vanadium oxide prepared by the melt-quenching technique as taught by Guestaux in U.S. Pat. No. 4,203,769. The sulfopolyester used was AQ29D commercially available from Eastman Chemical Company, Kingsport, Tenn. A coating aid of Triton X-100 surfactant (Rohm and Haas) was used. Coating dispersions were formulated for AQ29D/vanadium oxide/surfactant weight ratios of 1/1/1, 11/1/1, and 22/1/1.

The coating formulations were applied, using a coating hopper, to a moving web of nominally 0.1 millimeter thick polyethylene naphthalate to form an electrically-conductive antistatic layer. The polyethylene naphthalate web was surface-treated by glow-discharge treatment using a nitrogen atmosphere prior to coating the electrically conductive antistatic layer. The surface-treatment was carried out at powers ranging from 60 to 600 W and residence times ranging from 0.6 to 3 seconds corresponding to doses ranging from 0.07 J/cm$^2$ to 3.6 J/cm$^2$. Pressures ranged from 50 to 150 mTorr.

The electrically conductive antistatic layers were coated at a wet coverage of 0.017 cm$^3$/m$^2$ corresponding to a dry coating coverage of approximately 0.113 g/m$^2$ (total solids).

The electrically conductive layers were overcoated with a transparent magnetic layer as described in Research Disclosure, Item 34390, November, 1991. The transparent magnetic layer comprised a dispersion of cobalt-modified γ-iron oxide particles in a polymeric binder with an optional cross-linker and optional abrasive particles. The polymeric binder was a mixture of cellulose diacetate and cellulose triacetate. Total dry coverage for the magnetic layer was nominally about 1.5 g/m$^2$. A lubricant-containing layer comprising carnauba wax and a fluorinated surfactant as a wetting aid was coated on top of the transparent magnetic layer at a nominal dry coverage of about 0.02 g/m$^2$.

For nitrogen glow-discharge treated support, poor dry adhesion was obtained for all samples in the indicated treatment dose range and formulation range except for the ratios of 22/1/1 AQ29D/$V_2O_5$/ surfactant. Consequently, a formulation of 22/1/1 was used for all further investigations on glow-discharge treated polyethylene naphthalate. The coating formulation used is as follows:

| Component | Weight % (dry) | Weight % (wet) |
|---|---|---|
| Vanadium oxide | 4.2 | 0.026 |
| AQ29D | 91.6 | 0.571 |
| Triton X-100 | 4.2 | 0.026 |
| Water | — | balance |

The coating formulation was similarly applied to glow-discharge treated supports to give a total dry coverage of approximately 0.112 g/m$^2$ and overcoated with the transparent magnetic recording layer. The WER and adhesion results as a function of treatment dose are indicated in Table 1.

TABLE 1

Vanadium Oxide/Sulfopolyester Antistatic Layer on Oxygen Glow-Discharge Treated Polyethylene Naphthalate.

| No. | gas | Dose (J/cm$^2$) | Press mTorr | WER log Ω/sq | dry adh. | wet adh. |
|---|---|---|---|---|---|---|
| C-1a | $O_2$ | 0.07 | 150 | 7.2 | excellent | poor |
| C-1b | $O_2$ | 1.20 | 100 | 7.1 | excellent | fair |
| C-1c | $O_2$ | 3.60 | 50 | 7.2 | excellent | very poor |
| C-1d | $N_2$ | 0.07 | 50 | 7.4 | excellent | excellent |
| C-1e | $N_2$ | 1.31 | 50 | 7.3 | fair | poor |
| C-1f | $N_2$ | 3.60 | 50 | 7.6 | excellent | poor |

This example demonstrates that it is possible to use antistatic formulations well known in the prior art to achieve adhesion to surface-treated polyester support. However, as demonstrated here it is difficult to satisfy both wet and dry adhesion for a multiple layer system. Optimization of the electrically conductive antistatic layer formulation and treatment conditions was required to achieve adequate adhesion. However, this requires very specific chemistries and consequently a narrow treatment range. Therefore, this system does not have the desired adhesion robustness and may be difficult to scale-up or modify.

Comparative Example 2

Antistatic coating formulations similar to those described in U.S. Pat. No. 4,203,769 comprising a vanadium oxide sol and either Latex A (a terpolymer latex comprised of vinylidene chloride, methylacrylate, and itaconic acid) or Latex B (a terpolymer latex comprised of vinylidene chloride, acrylonitrile, and acrylic acid) were prepared as follows:

| | Weight % (dry) | Weight % (wet) |
|---|---|---|
| Formulation A | | |
| Vanadium oxide | 4.2 | 0.026 |
| Terpolymer latex A | 91.6 | 0.571 |
| Triton X-100 | 4.2 | 0.026 |
| Water | — | balance |

-continued

| | Weight % (dry) | Weight % (wet) |
|---|---|---|
| Formulation B | | |
| Vanadium oxide | 16.33 | 0.024 |
| Terpolymer latex B | 66.67 | 0.098 |
| Triton X-100 | 17.00 | 0.025 |
| Water | — | balance |

The samples were coated on glow-discharge treated polyethylene naphthalate to give a dry coverage of approximately 0.113 g/m$^2$ for formulation A and 0.014 g/m$^2$ for formulation B. The electrically conductive antistatic layers were overcoated with the transparent magnetic recording layer described for comparative example 1.

TABLE 2

Vanadium Oxide/Vinylidene Chloride-Based Terpolymer Latex Layers on Glow-discharge Treated Polyethylene Naphthalate.

| No. | Polymer | Gas | Dose J/cm$^2$ | Press mTorr | WER log Ω/sq | Dry adh. | wet adh. |
|---|---|---|---|---|---|---|---|
| C-2a | A | $O_2$ | 0.07 | 150 | 9.0 | exc. | poor |
| C-2b | A | $O_2$ | 1.20 | 100 | 8.8 | exc. | poor |
| C-2c | A | $O_2$ | 3.60 | 50 | 8.9 | exc. | v. poor |
| C-2d | A | $N_2$ | 0.25 | 95 | 8.5 | exc. | poor |
| C-2e | A | $N_2$ | 1.3 | 50 | 8.7 | exc. | v. poor |
| C-2f | A | $N_2$ | 3.60 | 90 | 8.4 | exc. | v. poor |
| C-2g | B | $O_2$ | 0.18 | 150 | 7.6 | exc. | exc. |
| C-2h | B | $O_2$ | 0.90 | 100 | 7.1 | exc. | exc. |
| C-2i | B | $O_2$ | 3.60 | 50 | 7.3 | exc. | fair |
| C-2j | B | $N_2$ | 0.18 | 150 | 7.5 | exc. | fair |
| C-2k | B | $N_2$ | 0.90 | 100 | 7.8 | exc. | fair |
| C-21 | B | $N_2$ | 3.60 | 50 | 7.7 | exc. | fair |

Similar coatings of the terpolymer latex without antistatic agents indicated generally poor wet adhesion throughout the typical dose range, suggesting either hydrolytic attack of the adhesion promoting interaction as would occur for hydrogen bonding or suggesting a chemical incompatibility of the terpolymer and treated support in the presence of developer solution.

Comparative Examples 3 and 4

Some of the most common antistatic formulations for use in photographic imaging elements are conductive particles dispersed in a gelatin binder. Therefore, antistatic formulations comprising antimony-doped tin oxide or metal antimonates were prepared in gelatin for comparative examples 3 and 4, respectively. For comparative examples 3a–f, an electrically conductive antistatic layer comprised of tin oxide and gelatin with a resorcinol "bite" agent in a methanol-water system was prepared as taught by Murayama in U.S. Pat. No. 5,326,689 and additionally by Kawamoto (EP 0 674 218 A1) in which overcoating the electrically conductive antistatic layer with a cellulose diacetate based layer is taught.

The coating formulation was prepared according to the art taught in the above patents using the formulation indicated below. The electrically conductive antistatic layer was coated on glow-discharge treated polyethylene naphthalate at a nominal 0.3 μm coverage and subsequently overcoated with the cellulose acetate based transparent magnetic recording and lubricant layers previously described in comparative example 1. The glow-discharge treatment was carried out in either a nitrogen or oxygen atmosphere without the use of water vapor or heat treatment of the support. Adhesion and resistivity values are given in Table 3.

| Antistatic Layer Coating Formulation | |
|---|---|
| Tin oxide | 4 parts by weight |
| Gelatin | 1 |
| Water | 27 |
| Methanol | 60 |
| Resorcinol | 2 |
| Triton X-100 | 0.01 |

Inadequate adhesion as indicated in Table 3 was not unanticipated as Murayama taught that water vapor, preferably in combination with heat treatment of the support was required for adhesion.

In a similar manner, aqueous based gelatin electrically conductive antistatic layers were prepared for comparative examples 4 using metal antimonate conductive particles as taught by Christian and Anderson in U.S. Pat. No. 5,457,013. These were similarly overcoated with the transparent magnetic recording layer. The antistatic formulation is given below. The electrically conductive antistatic layers were coated to give a 0.45 g/m$^2$ total dry coverage. The samples were found to have excellent dry adhesion as reported by Christian and Anderson, but similar to the tin oxide/gelatin samples exhibited insufficient wet adhesion.

| Component | Weight % (dry) | Weight % (wet) |
|---|---|---|
| $ZnSb_2O_6$ | 89.4 | 1.8 |
| gelatin | 9.9 | 0.2 |
| hardener* | 0.2 | 0.004 |
| Wetting aid (saponin) | 0.5 | 0.01 |
| Water | — | balance |

*2,3-dihydroxy-1,4-dioxane

TABLE 3

Gelatin/Tin Oxide Based Antistatic Layer on GDT Support.

| No. | Gas | Dose J/cm$^2$ | Press mTorr | WER log W/sq | Dry adh. | Wet adh. |
|---|---|---|---|---|---|---|
| 3a | $O_2$ | 0.7 | 150 | 12.5 | v. poor | v. poor |
| 3b | $O_2$ | 1.2 | 100 | 12.5 | v. poor | v. poor |
| 3c | $O_2$ | 0.36 | 50 | 12.5 | v. poor | v. poor |
| 3d | $N_2$ | 0.7 | 150 | 12.5 | v. poor | v. poor |
| 3e | $N_2$ | 1.2 | 100 | 12.5 | v. poor | v. poor |
| 3f | $N_2$ | 0.36 | 50 | 12.5 | v. poor | v. poor |
| 4a | $O_2$ | 0.4 | 100 | 7.5 | exc. | fair |
| 4b | $N_2$ | 0.9 | 70 | 7.5 | exc. | good |

Comparative examples 1–4 indicate that antistatic formulations as taught in the prior art are not generally suited to provide adequate adhesion for the described imaging element coated on polyester supports. The electrically conductive antistatic layers described above may have adequate initial adhesion to surface-treated polyester, however, when overcoated with a transparent magnetic recording layer as in the preferred embodiment, the antistatic compositions of the prior art do not provide adequate dry and wet adhesion for the full package imaging element over a wide range of treatment conditions. There are particular instances in which both dry and wet adhesion are adequate, however, these are limited to specific ranges of glow-discharge doses, pressures or gases which are known to correspond to a specific set of functionalities or surface chemistry for adhesion. Furthermore, the composition of the electrically conductive antistatic layer may be limited to a narrow range in order to obtain the required adhesion with the surface chemistry associated with a support treated by a particular method.

EXAMPLE 1

An antistatic coating formulation comprising zinc antimonate dispersed in an aliphatic, anionic polyurethane binder having an ultimate elongation to break of at least 350 in accordance with the present invention (Witcobond W-236, ultimate elongation 450%) was applied using a coating hopper to a moving web of 0.1 millimeter thick polyethylene naphthalate to form an electrically-conductive layer. The polyethylene naphthalate was treated by glow-discharge using either an oxygen or nitrogen atmosphere. Similar to the comparative examples, the surface-treatment was carried out at powers ranging from 60 to 600 W and residence times ranging from 0.6 to 3 seconds corresponding to doses ranging from 0.07 to 3.6 J/cm$^2$. Pressures were from 50 to 150 mTorr. The antistatic coating formulation is described below:

| Component | Weight % (dry) | Weight % (wet) |
|---|---|---|
| Colloidal $ZnSb_2O_6$ | 69.13 | 1,874 |
| W-236* | 29.64 | 0.803 |
| Triton X-100 | 1.23 | 0.033 |
| Water | — | balance |

*Witco Corp. Greenwich, CT

The electrically conductive antistatic layers were coated at a wet coating coverage of approximately 0.20 cm$^3$/m$^2$ corresponding to a dry coverage of 0.60 g/m$^2$ (total solids).

The electrically conductive layers were overcoated with a transparent magnetic layer and lubricant layer as described for comparative example 1. WER and adhesion results for the various treatment conditions are given in Table 4.

TABLE 4

Glow-discharge Treatment Variations for a Zinc Antimonate Antistatic Layer.

| No. | Gas | Dose J/cm$^2$ | Press mTorr | WER log Ω/sq | Dry adh. | Wet adh. |
|---|---|---|---|---|---|---|
| 1a | $O_2$ | 0.07 | 150 | 9.5 | exc. | exc. |
| 1b | $O_2$ | 0.07 | 50 | 9.6 | exc. | exc. |
| 1c | $O_2$ | 0.36 | 150 | 9.5 | exc. | exc. |
| 1d | $O_2$ | 0.36 | 50 | 9.6 | exc. | exc. |
| 1e | $O_2$ | 0.72 | 150 | 9.5 | exc. | exc. |
| 1f | $O_2$ | 0.72 | 50 | 9.5 | exc. | exc. |
| 1g | $O_2$ | 1.2 | 100 | 9.5 | exc. | exc. |
| 1h | $O_2$ | 3.6 | 150 | 9.5 | exc. | exc. |
| 1i | $O_2$ | 3.6 | 50 | 9.6 | exc. | exc. |
| 1j | $N_2$ | 0.07 | 150 | 9.5 | exc. | exc. |
| 1k | $N_2$ | 0.07 | 50 | 9.6 | exc. | exc. |
| 1l | $N_2$ | 0.36 | 150 | 9.7 | exc. | exc. |
| 1m | $N_2$ | 0.36 | 50 | 9.6 | exc. | exc. |
| 1n | $N_2$ | 0.72 | 150 | 9.8 | exc. | exc. |
| 1o | $N_2$ | 0.72 | 50 | 9.6 | exc. | exc. |

TABLE 4-continued

Glow-discharge Treatment Variations for a Zinc Antimonate Antistatic Layer.

| No. | Gas | Dose J/cm$^2$ | Press mTorr | WER log Ω/sq | Dry adh. | Wet adh. |
|---|---|---|---|---|---|---|
| 1p | $N_2$ | 1.2 | 100 | 9.7 | exc. | exc. |
| 1q | $N_2$ | 3.6 | 150 | 9.8 | exc. | exc. |
| 1r | $N_2$ | 3.6 | 50 | 9.5 | exc. | exc. |

This example demonstrates that antistatic formulations of the present invention have excellent antistatic performance, dry adhesion, and wet adhesion for a greatly expanded range of glow-discharge treatment conditions than observed for the prior art. Surprisingly, the adhesion was not found to depend on treatment conditions within the range studied. This allows considerable flexibility in choosing a cost-effective treatment method or optimizing the treatment method for adhesion of a separate layer on the opposite side of the support from the electrically conductive antistatic layer. In particular, a two-sided treatment process could be tailored to the chemistry of the layers coated on the opposite side without compromising the performance or adhesion on the antistatic side.

EXAMPLES 2–13

Antistatic formulations similar to example 1 were prepared using a variety of appropriate polyurethane binders, antistatic materials, ratios of antistat/binder and total coverage of the electrically conductive antistatic layer. All of the binders are aliphatic, anionic polyurethanes characterized by an ultimate elongation of at least 350 percent. The antistatic formulations were comprised of the indicated binder, antistatic agent and Triton X-100 surfactant. The $SnO_2$ used in sample 11 was of the small crystallite size material predispersed with a commercially available dispersant (DEQUEST 2006 available from Monsanto Chemical Co.) as taught in U.S. Pat. No. 5,484,694. The carbon fibers used in example 12 were obtained from Applied Sciences, Inc. and predispersed in water with a commercial dispersing aid (Tamol SN available from Rohm and Haas) prior to formulating in the polyurethane binder. The antistatic formulations were all coated on polyethylene naphthalate web treated by glow-discharge treatment in oxygen for examples 2–12, and nitrogen for example 13. Treatment conditions were 1.2 J/cm$^2$ at 100 mTorr for examples 2–4; 0.9 J/cm$^2$ at 100 mTorr for examples 5 and 6; 0.72 J/cm$^2$ at 15 mTorr for examples 7–9; 0.4 J/cm$^2$ at 150 examples 10–12; and 0.90 J/cm$^2$ at 72 mTorr for example 13. The electrically conductive antistatic layers were all coated with a transparent magnetic recording layer and lubricant layer in the usual manner. Resistivity and adhesion results are given in Table 5.

TABLE 5

Antistatic Layer Variations on Glow-Discharge Treated Polyethylene Naphthalate.

| No. | Binder* | Ultimate elong. % | Antistat | Antistat/ binder | covg $g/m^2$ | WER log Ω/sq | Dry adh. | Wet adh. |
|---|---|---|---|---|---|---|---|---|
| 2 | W-290H | 600 | $ZnSb_2O_6$ | 70/30 | 0.60 | 9.1 | exc. | exc. |
| 3 | W-293 | 725 | $ZnSb_2O_6$ | 70/30 | 0.60 | 8.8 | exc. | exc. |
| 4 | W-506 | 550 | $ZnSb_2O_6$ | 70/30 | 0.60 | 9.9 | exc. | exc. |
| 5 | W-293 | 725 | $ZnSb_2O_6$ | 80120 | 0.50 | 8.4 | exc. | exc. |
| 6 | W-236 | 450 | $V_2O_5$ | 1/22 | 0.04 | 9.2 | exc. | exc. |
| 7 | W-236 | 450 | $ZnSb_2O_6$ | 85/15 | 0.60 | 8.3 | exc. | exc. |
| 8 | W-236 | 450 | $InSbO_4$ | 85115 | 0.40 | 8.1 | exc. | exc. |
| 9 | W-236 | 450 | $InSbO_4$ | 70/30 | 0.50 | 8.8 | exc. | exc. |
| 10 | W-236 | 450 | $ZnSb_2O_6$ | 60/40 | 0.60 | 9.5 | exc. | exc. |
| 11 | W-236 | 450 | $SnO_2$ | 80/20 | 0.60 | 7.1 | exc. | exc. |
| 12 | W-236 | 450 | C-fibers | 50/50 | 0.10 | 6.2 | exc. | exc. |
| 13 | W-234 | 350 | $ZnSb_2O_6$ | 70/30 | 0.60 | 10.5 | exc. | exc. |

*Witco Corp. Greenwich, CT

The above examples indicate the polyurethane binders of the present invention can be used in conjunction with a wide variety of antistatic materials in a range of antistatic/binder ratios without adversely affecting either dry or wet adhesion performance. This allows considerable flexibility in designing an electrically conductive antistatic layer for a specific application.

EXAMPLES 14–16

The antistatic formulation of example 6 was found to have excellent antistatic properties and adhesion. However, this formulation was found to have limited shelf-life (less than 48 hrs). The limited shelf life was not unanticipated as there have been several examples of optimized binders for improved stability of vanadium oxide gels including, e.g., U.S. Pat. Nos. 5,360,706; 5,427,835; and 5,439,785. In order to overcome the limited shelf life, a mixed melt process was used for example 14 to prepare an electrically conductive antistatic layer having the same nominal composition as example 6. In this process, rather than using a single coating formulation, two coating dispersions were prepared as follows:

| | Dispersion A | | Dispersion B | |
|---|---|---|---|---|
| | Weight % (dry) | Weight % (wet) | Weight % (dry) | Weight % (wet) |
| $V_2O_5$ gel | 50 | 0.09 | — | — |
| W-236 | — | — | 85 | 0.68 |
| Triton X-100 | 50 | 0.09 | 15 | 0.12 |
| Water | — | balance | — | balance |

Dispersions A and B were in-line mixed at a ratio of 1 to 3 just prior to the coating hopper to give a total wet coverage of 0.2 $cm^3/m^2$ resulting in a dry coverage of 0.04 $g/m^2$. The electrically conductive antistatic layer was overcoated in the usual manner with a transparent magnetic recording layer and a lubricant layer. The sample prepared by this method had a WER of 9.2 and both excellent dry and wet adhesion indicating no degradation of performance using the in-line mixing method. This alternate coating process allows greater coating and formulation flexibility and enables the optimization of starting solutions for improved shelf life or improved coating characteristics. Examples 15 and 16 were prepared in a similar fashion except using different starting solutions and/or flow rates to give a range of total dry coverages and $V_2O_5$/polyurethane ratios. Results are given in Table 6.

TABLE 6

Results for Mixed-melt Formation of Vanadium Oxide Containing Antistatic Layers.

| No. | Binder | Antistat | Antistat/ binder | covg $g/m^2$ | WER log Ω/sq | Dry adh. | Wet adh. |
|---|---|---|---|---|---|---|---|
| 14 | W-236 | $V_2O_5$ | 1/22 | 0.04 | 9.2 | exc. | exc |
| 15 | W-236 | $V_2O_5$ | 1/26 | 0.55 | 6.7 | exc. | exc. |
| 16 | W-236 | $V_2O_5$ | 1/56 | 0.55 | 7.4 | exc. | exc. |

EXAMPLES 17 AND 18

For examples 17*a–c* an antistatic formulation similar to example 1 was prepared having a weight ratio of antistat/binder of 80/20 formulated to give 0.60 $g/m^2$ total dry coverage. The indicated coating formulation was applied to polyethylene naphthalate supports which were surface-treated by corona-discharge treatment rather than by glow-discharge treatment. For example 18, the antistatic formulation of example 1 was coated on polyethylene naphthalate support which was treated by exposure to ultraviolet radiation. The polyester support was exposed for a total dose of approximately 0.72 $J/cm^2$ prior to coating using an $H^+$ bulb (Fusion Systems Inc.) producing major bands at wavelengths of 255, 265, 315, and 365 nm. The samples were overcoated in the usual manner. These examples demonstrate that the invention has excellent adhesion to a wide variety of surface-treatment methods despite considerable differences in expected surface chemistries from the different treatment methods as taught by Grace et al in U.S. Pat. No. 5,425,980 and as discussed earlier.

TABLE 7

Antistatic Layers Coated on Corona-Discharge Treated and Ultraviolet-Irradiated Polyethylene Naphthalate.

| No. | Treatment Method | Treatment Level | WER log Ω/sq | Dry adh. | Wet adh. |
|---|---|---|---|---|---|
| 17a | CDT | 150 W | 8.4 | exc. | exc. |
| 17b | CDT | 200 W | 8.3 | exc. | exc. |

TABLE 7-continued

| Antistatic Layers Coated on Corona-Discharge Treated and Ultraviolet-Irradiated Polyethylene Naphthalate. | | | | | |
|---|---|---|---|---|---|
| No. | Treatment Method | Treatment Level | WER log Ω/sq | Dry adh. | Wet adh. |
| 17c | CDT | 250 W | 8.5 | exc. | exc. |
| 18 | UV | 0.72 J/cm$^2$ | 9.6 | exc. | exc. |

EXAMPLE 19

An antistatic dispersion comprised of $ZnSb_2O_6$ colloidal particles dispersed in a polyurethane binder was prepared in a manner similar to Example 17, however the total coverage was 0.40 g/m$^2$. The antistatic dispersion was coated on glow-discharge treated polyethylene terephthalate rather than polyethylene naphthalate. Glow-discharge conditions were similar to those used in prior examples. The electrically conductive antistatic layer was overcoated in the usual manner. Results are given in Table 8.

TABLE 8

| Antistatic Layers Coated on Glow-discharge Treated Polyethylene Terephthalate. | | | | | | |
|---|---|---|---|---|---|---|
| No. | Gas | Dose J/cm$^2$ | Press mTorr | WER log Ω/sq | Dry Adh. | Wet Adh. |
| 19a | $O_2$ | 0.07 | 150 | 9.0 | exc. | exc. |
| 19b | $O_2$ | 1.2 | 100 | 8.9 | exc. | exc. |
| 19c | $O_2$ | 3.6 | 50 | 9.1 | exc. | exc. |
| 19d | $N_2$ | 0.07 | 150 | 9.0 | exc. | exc. |
| 19e | $N_2$ | 1.2 | 100 | 9.1 | exc. | exc. |
| 19f | $N_2$ | 3.6 | 50 | 8.9 | exc. | exc. |

This example demonstrates that the present invention can be used for additional polyester supports again with a wide range of treatment conditions giving excellent antistatic properties and adhesion performance.

EXAMPLES 20–30

Antistatic formulations similar to examples 1 and 6 were coated on glow-discharge treated polyethylene naphthalate supports. The electrically conductive antistatic layers were subsequently overcoated with at least a single layer overcoat of the described polymer and optional auxiliary layers. The overcoat layers used represent a variety of polymer types which are useful as binders for a wide range of auxiliary layers. Descriptions of the polymer overcoats are given below. The electrically conductive antistatic layers were further overcoated with the usual carnauba wax lubricant layer. Results for the various overcoated antistatic packages are given in Table 9.

TABLE 9

| Adhesion of Various Overcoat Materials. | | | | | | | | |
|---|---|---|---|---|---|---|---|---|
| Antistat No (A) | Binder (B) | A/B ratio | covg g/m$^2$ | overcoat layer | covg g/m2 | Dry adh. | Wet adh. |
| 20 $ZnSb_2O_6$ | W-293 | 90/10 | 0.35 | A | 1.4 | exc. | exc. |
| 21 $V_2O_5$ | W-293 | 11/22 | 0.04 | A | 1.4 | exc. | exc. |
| 22 $V_2O_5$ | W-236 | 1/4 | 0.04 | B | 1.5 | exc. | exc. |
| 23 $ZnSb_2O_6$ | W-236 | 80/20 | 0.40 | B | 1.5 | exc. | exc. |

TABLE 9-continued

| Adhesion of Various Overcoat Materials. | | | | | | | | |
|---|---|---|---|---|---|---|---|---|
| 24 $ZnSb_2O_6$ | W-236 | 80/20 | 0.40 | C | 0.5 | exc. | exc. |
| 25 $AnSb_2O_6$ | W-236 | 80/20 | 0.40 | D | 0.5 | exc. | exc. |
| 26 $ZnSb_2O_6$ | W-236 | 80/20 | 0.40 | E | 0.5 | exc. | exc. |
| 27 $ZnSb_2O_6$ | W-236 | 80/20 | 0.40 | F | 0.5 | exc. | exc. |
| 28 $ZnSb_2O_6$ | W-236 | 80/20 | 0.40 | G | 0.5 | exc. | exc. |
| 29 $ZnSb_2O_6$ | W-236 | 80/20 | 0.40 | H | 0.5 | exc. | exc. |
| 30 $ZnSb_2O_6$ | W-236 | 80/20 | 0.40 | I | 0.5 | exc. | exc. |

| overcoat | polymer |
|---|---|
| A | Poly(methylmethacylate-co-methacrylic acid) 97/3 |
| B | Polyurethane (magnetics) (U.S. Pat. No. 5,451,495) |
| C | Polyurethane (aqueous) (anionic polycarbonate/polyurethane) |
| D | Cellulose Nitrate |
| E | Acrylonitrile-Butadiene (Tylac 68075, Reichhold Chemicals) |
| F | Polycarbonate (Merlon M40, Mobay Chemical) |
| G | Polystyrene (Styron 685, Dow Chemical) |
| H | Polyester (Poly(tetrachloroisopropylidenediphenylene-co-1,3-propylene terephthalate-co-isophthalate)) 97/3/50/50 |
| I | Polymethylmethacrylate (Elvacite 2010, E.I. DuPont) |

The above examples indicate that the polyurethane binder of the present invention provides excellent adhesion for a variety of polymeric overcoats including cellulosics, acrylics or acrylonitriles, polyurethanes, polycarbonates, and polystyrenes which can be used as the binder for auxiliary layers. This allows considerable flexibility in the design of imaging elements in which the overcoat material can be tailored for suitable transport, electrical, optical, and physical or other specific applications and maintain excellent adhesion.

Comparative Example 5

The coating formulation of example 17 was additionally coated on a polyethylene naphthalate web which was not subjected to an energetic treatment method nor subbed in the conventional manner. The electrically conductive antistatic layer was coated in the usual fashion and overcoated with the cellulosic based transparent magnetic recording layer and wax layer as in comparative Example 1. The sample had a WER of 8.2 log ohm/sq, very poor dry adhesion and good wet adhesion, demonstrating inferior adhesion without energetic surface-treatment of the polyester support. Similarly, very poor adhesion was found for untreated polyethylene terephthalate.

Comparative Examples 6–8

Electrically conductive antistatic layers and overcoat layers were prepared in a manner similar to example 1. However, the polyethylene naphthalate support was not treated by an energetic treatment method but rather was subbed in the conventional manner. In the present comparative example, the support had a tie layer comprised of a vinylidene chloride-based terpolymer latex. Table 10 compares the results for electrically conductive antistatic layer formulations coated on energetic surface-treated polyethylene naphthalate and conventional subbed polyester. These results indicate similar adhesion performance for the two adhesion promoting methods. The present invention achieves similar adhesion performance, however, avoids the complexities of an additional coating(s) with associated solvent emissions for conventional subbing materials. Furthermore, as demonstrated in Table 10, depending on the antistatic formulation (i.e., antistat/binder ratio) the energetic surface-treated polyester support may offer an improvement in antistatic performance over that obtained with an additional subbing layer. Comparative examples 6 and 7 show reduced antistatic performance when compared with examples 1 and 19. However, comparative examples 8 which has a higher loading of the conductive agent show similar antistatic performance to example 7. This allows the possibility of reduced antistatic loading for electrically conductive antistatic layers coated on surface-treated polyester supports rather than on conventionally subbed supports.

TABLE 10

Dependence on Antistatic Loading of Layers Coated on Surface-treated and Conventional Subbed Supports.

| Example | Antistat/binder | Covg g/m² | "Treatment" | WER log Ω/sq | Dry adhesion | Wet adhesion |
|---|---|---|---|---|---|---|
| Ex-1 | 70/30 | 0.60 | GDT | 9.5 | exc. | exc. |
| C-6 | 70/30 | 0.60 | conv. sub | 11.0 | exc. | exc. |
| EX-19 | 80/20 | 0.40 | GDT | 9.0 | exc. | exc. |
| C-7 | 80/20 | 0.40 | conv. sub | 10.0 | exc. | exc. |
| Ex-7 | 85/15 | 0.60 | GDT | 8.3 | exc. | exc. |
| C-8 | 85/15 | 0.60 | conv. sub | 8.3 | exc. | exc. |

Comparative Examples 9–13

For comparative examples 9–12, antistatic formulations were prepared similar to example 19 using zinc antimonate at an 80/20 ratio to polyurethane binder and coated to give a total dry coverage of 0.40 g/m². For comparative example 13, a coating similar to example 1 was prepared using zinc antimonate at a 70/30 ratio to polyurethane binder and coated to give a total dry coverage of 0.60 g/m². However, the polyurethane binders which were used were either nonionic, aromatic, or had an ultimate elongation less than 350 percent as indicated below.

| Polyurethane | Type | Particle charge | Ultimate Elongation % |
|---|---|---|---|
| W-160* | aromatic | anionic | 725 |
| W-240* | aliphatic | anionic | 70 |
| W-252* | aliphatic | anionic | 300 |
| W-320* | aliphatic | nonionic | 650 |
| NeoRez R-960+ | aliphatic | anionic | 200 |

*Witco Corp. Greenwich, CT
+Zeneca Resins, Wilmington, Ma.

The formulations were coated on nitrogen glows discharge treated polyethylene naphthalate support and subsequently overcoated with a cellulose based transparent magnetic recording layer. The WER and adhesion results are given in Table 11.

TABLE 11

Adhesion and Resistivity Results of Polyurethane Binders Which Do Not Satisfy the Selection Criteria.

| No. | Binder | Dose J/cm² | Press mTorr | WER log Ω/sq | dry adhesion | wet adhesion |
|---|---|---|---|---|---|---|
| C-9a | W-160 | 0.07 | 150 | 9.2 | fair | good |
| C-9b | " | 1.2 | 100 | 9.2 | exc. | exc. |

TABLE 11-continued

Adhesion and Resistivity Results of Polyurethane Binders Which Do Not Satisfy the Selection Criteria.

| No. | Binder | Dose J/cm² | Press mTorr | WER log Ω/sq | dry adhesion | wet adhesion |
|---|---|---|---|---|---|---|
| C-9c | " | 3.6 | 50 | 9.1 | exc. | exc. |
| C-10a | W-240 | 0.07 | 150 | 8.9 | v. poor | exc. |
| C-10b | " | 1.2 | 100 | 9.0 | v. poor | exc. |
| C-10c | " | 3.6 | 50 | 9.0 | v. poor | exc. |
| C-11a | W-320 | 0.07 | 150 | 8.2 | v. poor | poor |
| C-11b | " | 1.2 | 100 | 8.2 | fair–poor | fair |
| C-11c | " | 3.6 | 50 | 8.3 | v. poor | poor |
| C-12a | R-960 | 0.18 | 150 | 9.7 | v. poor | — |
| C-12b | " | 0.9 | 100 | 9.7 | v. poor | — |
| C-12c | " | 3.6 | 50 | 9.4 | v. poor | — |
| C-13 | W-252 | 0.90 | 72 | 9.8 | exc. | poor |

Due to the uniformly poor dry adhesion of comparative example 12, no wet adhesion information was obtained. While not uniformly excellent, comparative example 9 exhibited reasonably good results on polyethylene naphthalate. The same formulation was also coated on polyethylene terephthalate treated with a 1.2 J/cm² dose at 100 mTorr using either oxygen or nitrogen. The samples on polyethylene terephthalate showed only fair-poor dry adhesion. Additionally, use of aromatic polyurethanes is generally less desirable in imaging elements as aliphatic polyurethanes typically demonstrate increased UV stability. These examples demonstrate that other polyurethane binders not meeting the criteria set forth herein either have poor adhesion for the imaging element package or have a limited range of treatment conditions that give adequate adhesion.

The above examples have demonstrated that the present invention can be used for a variety of antistatic materials and formulations allowing the tailoring of the electrically conductive antistatic layer to a variety of application needs. Furthermore, the present invention can be applied to a variety of polyester supports which are modified by a variety of energetic surface-treatment methods. The electrically conductive antistatic layer of the present invention also provides adhesion for a variety of other polymers which may be coated over the electrically conductive antistatic layer and used as the binder for auxiliary functional layers. The present invention achieves both excellent wet and dry adhesion without the use of additional adhesive or subbing layers which have the drawback of increased solvent emissions and coating complexity. Furthermore, adhesion is achieved without the use of etch agents or other adhesion promoting species such as phenolics, epoxides, or chlorinated materials in the electrically conductive antistatic layer. The simple coating formulation, flexibility and robustness allow the electrically conductive antistatic layer to be used in a wide variety of imaging element packages.

We claim:

1. A composite support for an imaging element, comprising a polymeric film and an electrically conductive layer, wherein the polymeric film comprises a surface which has been activated by energetic treatment, the electrically conductive layer comprises an electrically conductive agent dispersed in an aqueous dispersible polymeric binder comprising an aliphatic, anionic polyurethane having an ultimate elongation to break of at least 350 percent, and the electrically conductive layer is in contiguous contact with the activated surface of the polymeric film.

2. A composite support according to claim 1 in which the electrically conductive layer is overcoated with at least one auxiliary layer comprising a polymeric binder.

3. A composite support according to claim 2 wherein the polymeric binder of the auxiliary layer comprises cellulose or a cellulose derivative, a polyurethane, an acrylic or acrylamide polymer, a polycarbonate, a polyester, a polystyrene, or gelatin.

4. A composite support according to claim 3 wherein the polymeric binder of the auxiliary layer comprises cellulose nitrate, cellulose diacetate, cellulose triacetate, or cellulose acetate butyrate.

5. A composite support according to claim 3 wherein the polymeric binder of the auxiliary layer comprises a polyurethane.

6. A composite support according to claim 3 wherein the polymeric binder of the auxiliary layer comprises an acrylic or acrylamide polymer.

7. A composite support according to claim 3 wherein the polymeric binder of the auxiliary layer comprises a polycarbonate.

8. A composite support according to claim 3 wherein the polymeric binder of the auxiliary layer comprises a polyester.

9. A composite support according to claim 3 wherein the polymeric binder of the auxiliary layer comprises a polystyrene.

10. A composite support according to claim 2 in which the auxiliary layer is a transparent magnetic recording layer.

11. A composite support according to claim 10 wherein the transparent magnetic recording layer comprises $Fe_2O_3$ or $Fe_3O_4$ magnetic particles dispersed in a polymeric binder.

12. A composite support according to claim 1 wherein the electrically conductive agent comprises fine particles of ZnO, $TiO_2$, $SnO_2$, $Al_2O_3$, $In_2O_3$, $SiO_2$, MgO, BaO, $MOO_3$, $WO_3$, or a compound oxide thereof.

13. A composite support according to claim 1 wherein the electrically conductive agent comprises: ZnO which contains from 0.01 mole % to 30 mole % of a dopant comprising Al or In; $SnO_2$ which contains from 0.01 mole % to 30 mole % of a dopant comprising Sb, Nb, or a halogen atom; or $TiO_2$ which contains from 0.01 mole % to 30 mole % of a dopant comprising Nb or Ta.

14. A composite support according to claim 1 wherein the electrically conductive agent comprises antimony doped $SnO_2$ at an antimony doping level of at least 8 atom % and having an X-ray crystallite size less than 100 Å and an average equivalent circular diameter less than 15 nm but no less than the X-ray crystallite size.

15. A composite support according to claim 1 wherein the electrically conductive agent comprises electrically conductive metal antimonate particles.

16. A composite support according to claim 15 wherein the electrically conductive agent comprises zinc antimonate or indium antimonate.

17. A composite support according to claim 1 wherein the electrically conductive agent comprises vanadium oxide gel.

18. A composite support according to claim 17 wherein the vanadium oxide gel comprises silver doped vanadium pentoxide.

19. A composite support according to claim 1 wherein the electrically conductive agent comprises conductive carbon fibers.

20. A composite support according to claim 1 wherein the polymeric film is a polyester film.

21. A composite support according to claim 20 wherein the polymeric film comprises polyethylene terephthalate or polyethylene naphthalate.

22. A composite support according to claim 1 wherein the polymeric film has been surface-treated by corona-discharge.

23. A composite support according to claim 1 wherein the polymeric film has been surface-treated by glow-discharge.

24. A composite support according to claim 23 wherein the glow-discharge atmosphere comprised oxygen, nitrogen, helium, argon, carbon dioxide, ammonia, or water vapor.

25. A composite support according to claim 23 wherein the glow-discharge atmosphere comprised oxygen or nitrogen.

26. A composite support according to claim 1 wherein the polymeric film has been surface-treated by exposure to ultraviolet radiation.

27. An imaging element for use in an image-forming process, comprising a support, an image-forming layer, and an electrically conductive layer, wherein the support comprises a polymeric film having a surface which has been activated by energetic treatment, the the electrically conductive layer comprises an electrically conductive agent dispersed in an aqueous dispersible polymeric binder comprising an aliphatic, anionic polyurethane having an ultimate elongation to break of at least 350 percent, and the electrically conductive layer is in contiguous contact with the activated surface of the support.

28. An imaging element according to claim 27 in which the electrically conductive layer and the image forming layer are on the same side of the support.

29. An imaging element according to claim 27 in which the electrically conductive layer and image forming layer are on opposite sides of the support.

30. An imaging element according to claim 27 in which the image forming layer comprises silver halide grains dispersed in gelatin.

31. A photographic imaging element comprising a polyester film support, at least one photographic image recording layer comprised of silver halide grains dispersed in a gelatin binder on one side of the support, an electrically conductive layer on the side of the support opposite to the image recording layer, and a transparent magnetic recording layer overlying the electrically conductive layer, wherein the support comprises a surface which has been activated by energetic treatment, the electrically conductive layer comprises an electrically conductive agent dispersed in an aqueous dispersible polymeric binder comprising an aliphatic, anionic polyurethane having an ultimate elongation to break of at least 350 percent, and the electrically conductive layer is in contiguous contact with the activated surface of the support.

32. A photographic imaging element according to claim 31, further comprising a permeability control layer for reduced water permeability coated between the electrically conductive layer and the transparent magnetic recording layer.

* * * * *